US005336441A

United States Patent [19]

Shah et al.

[11] Patent Number: 5,336,441

[45] Date of Patent: Aug. 9, 1994

[54] CORROSION INHIBITION IN HIGHLY ACIDIC ENVIRONMENTS BY USE OF PYRIDINE SALTS IN COMBINATION WITH CERTAIN CATIONIC SURFACTANTS

[75] Inventors: Sayed S. Shah; William F. Fahey; Bernardus A. Oude Alink, all of St. Louis, Mo.

[73] Assignee: Petrolite Corporation, St. Louis, Mo.

[21] Appl. No.: 706,661

[22] Filed: May 29, 1991

[51] Int. Cl.[5] ..... C23F 11/14

[52] U.S. Cl. ..... 252/390; 252/8.555; 422/16; 546/348; 106/14.43; 106/14.16; 106/14.15

[58] Field of Search ..... 252/8.555, 390, 355, 252/357; 422/16; 534/604, 389; 106/14.43; 546/348

[56] References Cited

U.S. PATENT DOCUMENTS

| | | | |
|---|---|---|---|
| 2,006,216 | 6/1935 | Macarthur et al. | 148/8 |
| 2,617,771 | 11/1952 | Rucker | 252/149 |
| 3,121,091 | 2/1964 | Green | 252/390 |
| 3,252,980 | 5/1966 | Bolmer et al. | 260/290 |
| 3,759,930 | 9/1973 | Schorre et al. | 546/116 |
| 3,885,913 | 5/1975 | Redmore et al. | 21/2.7 R |
| 3,982,894 | 9/1976 | Annand et al. | 21/2.7 R |
| 4,071,746 | 1/1978 | Quinlan | 252/392 |
| 4,297,484 | 10/1981 | Quinlan | 528/423 |
| 4,541,946 | 9/1985 | Jones et al. | 252/189 |
| 4,770,906 | 9/1988 | Harwell | 427/212 |
| 4,900,627 | 2/1990 | Harwell et al. | 428/403 |
| 5,000,873 | 3/1991 | Fisk et al. | 252/391 |

OTHER PUBLICATIONS

Jerry March, *Advanced Organic Chemistry: Reactions Mechanisms, and Structure,* 3rd edition (John Wiley and Sons, Inc.) p. 364.

European Search Report.

*Primary Examiner*—Richard D. Lovering
*Assistant Examiner*—Valerie Fee
*Attorney, Agent, or Firm*—Kenneth Solomon

[57] ABSTRACT

A method for inhibiting corrosion of ferrous surfaces in an acidic, aqueous medium is disclosed. The method comprises incorporating into the medium a corrosion-inhibiting amount of a pyridine salt composition (comprising a quaternary pyridine salt composition and/or a pyridine.HCL salt composition) and a cationic surfactant that forms a bilayer on the ferrous surfaces in the medium. Highly quaternized pyridine salt compositions useful in such method and a method for preparation of such compositions are also disclosed.

18 Claims, No Drawings

CORROSION INHIBITION IN HIGHLY ACIDIC ENVIRONMENTS BY USE OF PYRIDINE SALTS IN COMBINATION WITH CERTAIN CATIONIC SURFACTANTS

BACKGROUND OF THE INVENTION

1. Field of the Invention

The present invention relates to corrosion inhibition in acidic, aqueous media, and more particularly to inhibition of corrosion of ferrous surfaces in refinery overhead streams and distillation towers.

2. Description of the Prior Art

A solution has long been sought to the common and troublesome problem of corrosion of ferrous surfaces in oil refinery overhead streams, towers and tower pump around systems (in particular, of the crude distillation unit and vacuum distillation tower) and other distillation towers. In particular, it has been difficult to solve the problem because such streams are highly acidic, typically having a pH of from less than 1 to about 3, and are maintained at temperatures exceeding about 200° F. (93° C.). By contrast, conventional corrosion inhibitors generally are employed in environments that are characterized by far less severe conditions. For example, corrosion inhibitors employed in oil field pipelines generally are not considered satisfactory corrosion inhibitors for refinery overhead streams and distillation towers, first because the disparate nature of the oil field pipeline and refinery/distillation arts results in a failure to consider application of corrosion inhibitors from one art to another art, but also because oil field pipelines ordinarily are not strongly acidic (rarely, if ever, having a pH below about 4) and are at generally ambient temperatures. Thus, oil field corrosion inhibitors are not recognized as effective in highly acidic, high temperature conditions, which conditions themselves increase corrosion rates dramatically.

Accordingly, whereas the refinery and distillation streams include the strong acid, HCl, with which the corrosion therein is associated, and are maintained at a temperature of at least about 200° F. (93° C.), and often as high as 300° F. (149° C.) or more, oil field pipeline corrosion is associated with weak acids due to the presence of hydrogen sulfide and carbon dioxide and typical pipeline temperatures are under 100° F. (38° C.).

Because corrosion inhibitors have not been found to be satisfactory under the low pH, high temperature conditions of refinery overhead streams and distillation towers, it has been common practice to attempt to resolve at least the acidity problem by neutralizing the stream by addition of ammonia or certain organic amines, such as ethylene diamine, to raise the pH above 4 (generally to about 6) before addition of the corrosion inhibitor. This technique has been found to be unsatisfactory not only because of the extra treatment step and extra additive required, but also because the amines added to the stream tend to form corrosive HCl salts, which tend to exacerbate the problem and to corrode. Efforts to find suitable corrosion inhibitors for such applications typically have not produced entirely satisfactory results.

Accordingly, while U.S. Pat. Nos. 4,332,967 and 4,393,026, both to Thompson et al., mention that the particular compounds disclosed therein might be applicable to refineries or distillation towers, corrosion inhibitors for oil field pipelines are not recognized to be applicable generally to refinery overhead streams, especially without first neutralizing the HCl in such streams. Thompson et al. also mentions (at col. 20, lines 29–33 of '967 and col. 20, lines 4–8 of '026) that the corrosion inhibitors described therein are effective in systems of "high temperature, high pressure and high acidity, particularly in deep wells, and most particularly in deep gas wells." However, the acidity of such wells is recognized not to be below about pH 3.5, generally not below pH 4. Thus, Thompson et al. do not suggest that the compositions described therein would be effective at lower pH's (as found in refinery overheads), or that their use in refineries would be in a manner other than the standard, conventional technique, which calls for addition of ammonia or an amine to increase the pH above 4 (with the problems connected therewith). And more generally, conventional corrosion inhibitors have been found to be either ineffective or susceptible to entering into undesirable side reactions in the highly acidic conditions of refinery overheads.

Thus, corrosion inhibitors that are effective in the low pH, high temperature conditions of refinery overhead streams without the need for neutralizing the HCl in such streams are needed.

SUMMARY OF THE INVENTION

Briefly, therefore, the present invention is directed to a novel method for inhibiting corrosion of ferrous surfaces in an acidic, aqueous medium. The method comprises incorporating into the medium a corrosion-inhibiting amount of (1) a pyridine salt composition comprising a quaternary pyridine salt and/or an HCl salt of a pyridine, and (2) a cationic surfactant that forms a bilayer on the ferrous surfaces in the medium.

The present invention is also directed to a quaternary pyridine salt composition is at least about 70% quaternized, and to a method for preparation of such quaternary pyridine salt. According to the method, a nonaqueous mixture of a pyridine and a compound of the formula R-X wherein R is selected from the group consisting of alkyl and aryl groups of up to about six carbon atoms, and X is a halide, are heated to at least about 50° C. until the pyridine is at least 70% quaternized.

Among the several advantages found to be achieved by the present invention, therefore, may be noted the provision of a method for inhibiting corrosion in highly acidic, aqueous media; the provision of a method for inhibiting corrosion in such media without the need for first introducing neutralizing amines; the provision of a highly quaternized pyridine composition in such method; and the provision of a method for preparation of such highly quaternized pyridine composition.

DESCRIPTION OF THE PREFERRED EMBODIMENTS

In accordance with the present invention, it has been discovered that introducing into a highly acidic, aqueous medium a pyridine salt composition (either a quaternary salt and/or an HCl salt) together with a cationic surfactant that forms a bilayer on metal surfaces substantially inhibits corrosion of ferrous surfaces in the medium. Moreover, it has been found that superior corrosion inhibition results if the pyridine salt composition is a quaternary pyridine composition that is at least about 70% quaternized. Surprisingly, it has been found that including in the medium the pyridine salt composition in combination with the particular type of surfactant of this invention results in substantially greater corrosion inhibition than is achieved when the quaternary pyridine salt is employed without the surfactant or with other types of surfactants employed previously.

Generally, a quaternary pyridine salt may be prepared by reacting a pyridine with a quaternization agent. As used herein, the term "pyridine" refers to substituted as well as unsubstituted pyridine. In preparing the quaternary salt, it is desirable to have a highly reactive pyridine nitrogen. Thus, if the pyridine is substituted, it is preferred that the substitutions not be at the 2 and 6 positions of the pyridine ring. Thus, the substituent(s) may be an alkyl group of from about 10 to about 18 carbon atoms, preferably about 12 carbon atoms or an aryl group of up to about six carbon atoms. Most preferably, the substituent(s) is a linear alkyl group. The substituent may have a limited number of hetero atoms, but not such as to reduce the positive charge of the ring nitrogen or, in the case of nitrogen, not such as to provide a quaternization site in competition with the ring nitrogen.

It has been found that highly quaternized pyridine salt compositions are especially effective in the method of this invention. In order to achieve such a high degree of quaternization, therefore, pyridines with highly reactive ring nitrogens are particularly desirable.

The pyridine is reacted with a quaternization agent such as a composition of the formula R-X, wherein R is selected from among alkyl and aryl groups and X is a halide. Preferably, the alkyl or aryl group has at most about 6 carbon atoms. Benzyl and methyl are especially suitable for R, and benzyl chloride has been found to be an especially desirable quaternization agent.

As used herein, reference to the degree of quaternization of a quaternary pyridine salt composition means the percentage of the pyridines in the composition that has been quaternized. In other words, if a quaternary pyridine salt composition is described as, for example, 70% quaternized, 70% of the pyridines in the composition have been quaternized.

It has been found that by conducting the quaternization reaction in a nonaqueous (or at least low water) environment, a much greater degree of quaternization can be achieved than in the standard preparation technique employing water as the solvent. Thus, whereas commercial quaternary pyridine salt compositions, which are commonly prepared with an aqueous solvent, generally are 40–50% quaternized, compositions quaternized about 70% or more can be achieved with a nonaqueous solvent such as an alcohol, for example, methanol, isopropanol, butanol, etc. Excellent results have been achieved with methanol as the solvent.

Although preferred classes of pyridines and quaternary pyridine salt compositions have been set forth above, it is believed that any of the pyridines and quaternary salts thereof as disclosed in U.S. Pat. No. 4,071,746 to Quinlan or in U.S. Pat. No. 4,541,946 to Jones et al. would be appropriate in the method of this invention. However, it is still preferred that the degree of quaternization exceed about 70%.

The reaction may be conducted as a batch process by heating the mixture of the pyridine, the quaternization agent and the nonaqueous solvent in a vessel. The reaction mixture, which typically comprises approximately a 1:1 molar ratio of the pyridine and the quaternization agent, is heated to a temperature in the range of from about 50° C. to about 180° C. preferably about 100° C. If desired, the reaction may be carried out under pressure to permit temperatures that would otherwise exceed the boiling point of the solvent. The temperature is maintained elevated until the desired degree of quaternization (e.g., 70%) is achieved, as determined by titration. The reaction is then halted by cooling the mixture, or at least by halting the application of heat. The reaction product may then be employed in the medium to be treated.

The cationic surfactants employed in the method of this invention are the type that have been associated with the bilayer phenomenon in which the surfactant forms a bilayer on metal surfaces and, in particular, on ferrous surfaces in the media to be treated with the additives of this invention. This phenomenon is described, for example, in U.S. Pat. Nos. 4,770,906 and 4,900,627 to Harwell et al. Examples of such surfactants are certain quaternary ammonium compounds, namely: (a) quaternary ammonium halides of the formula:

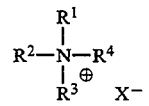

wherein $R^1$ is an alkyl or alkylaryl group of from about 12 to about 18 carbon atoms, the aryl portion of the alkylaryl group containing no more than about six carbon atoms, $R^2$–$R^4$ are independently selected from among methyl, ethyl and benzyl, provided that at most only one of $R^2$–$R^4$ is benzyl, and X is a halide, preferably bromide or chloride; and (b) quaternary salts of mono-haloalkyl ethers or dihaloalkyl ethers of from 2 to about six carbon atoms and trialkyl amines of the formula:

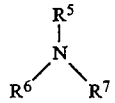

wherein $R^5$ is an alkyl group of from about 12 to about 18 carbon atoms, and $R^6$ and $R^7$ are independently selected from among methyl, ethyl and propyl, provided that the total number of carbon atoms of $R^6$ and $R^7$ is at most about four.

Suitable compositions of class (a) may be prepared by forming quaternary salts of compounds having the formula R-X (wherein R and X are defined as above with respect to quaternizing the pyridine) and trialkyl amines as described above with respect to class (b). Particular preferred quaternaries of this class are cetyltrimethyl ammonium bromide and the quaternary salt of benzyl chloride and dimethylcocoamine.

The mono- or di-haloalkyl ether of class (b) is preferably dichloroethyl ether. Especially preferred cationic surfactants, therefore, are quaternaries of benzyl chloride and dimethylcocoamine, quaternaries of dichloroethyl ether and dimethylcocoamine, and cetyltrimethyl ammonium bromide, with quaternaries of benzyl chloride and dimethylcocoamine being most preferred. The quaternaries are formed by reaction of approximately equimolar amounts of the reactants.

The pyridine salt composition and the cationic surfactant may be incorporated separately into the aqueous, acidic medium to be treated, or they may be first blended together and the blend added to the medium. The pyridine salt composition and the cationic surfactant may be employed in a relative pyridine salt composition:surfactant weight proportion of from about 1:5 to about 5:1, preferably about 2:1.

If the pyridine salt composition and surfactant are employed as a blend, the blend may also include a carrier or other components as desired, such as an alcohol (e.g., methanol or isopropanol) and/or water.

It has been found that the additive of this invention is effective over a broader range of low pH's than prior art compositions, generally any pH below about 8, but its effectiveness is particularly notable in aqueous, acidic media. It is especially applicable to such media having a pH less than 6. Moreover, in view of the unsatisfactory results of previous corrosion inhibitors in highly acidic media, the benefits of the additive particularly notable for media having a pH under 5, and even more notable for media having a pH less than about 4, especially less than about 3, at which pH prior art compositions are understood to be unsuitable. Likewise, the additives of this invention have been found effective even for media having a temperature in excess of about 200° F. (93° C.).

The components or blend may be incorporated into the medium or injected into a distillation column by any standard technique. For example, where the medium is in an overhead refinery unit, the composition(s) may be injected with an appropriate carrier into the water stream of the overhead of the distillation unit. However, if desired, the additive may be formulated as an oil soluble product, such as by addition of alcohol or kerosene, and injected into the oil phase. From about 25 to about 500 ppm (preferably about 50 ppm) by weight of the active components (salt composition plus surfactant) based on the water phase has been found to be effective.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples all percentages are given on a weight basis unless otherwise indicated.

EXAMPLE 1

In the refinery overhead the composition of liquids in general is about 5% water and 95% hydrocarbons with varying amounts of chlorides, some sulfates and dissolved $H_2S$ at low pH. Under these conditions, corrosion occurs in the aqueous phase. Because of the infeasibility of electrochemical measurement of corrosion rates in a 5% water and 95% hydrocarbon mixture, it was therefore decided to use 2 parts water and 1 part hydrocarbon. If anything, this composition makes the system more corrosive, thus an inhibitor that is capable of controlling corrosion under these conditions should prove more effective under the field conditions. For these corrosion measurements, kettles filled with 600 ml of 0.1M $Na_2SO_4$ (an inert supporting electrolyte to enable electrochemical measurements to be made in the tests) and 300 ml of Isopar-M (a trade designation for a distilled hydrocarbon obtained from Exxon) were used. The pH of the solution was adjusted to 3 with about 1% HCl and then maintained at 3 using 0.1M HCl with the help of the pH controllers. Therefore, the chloride concentration was about 35 ppm. The mixture was sparged with 1% $H_2S$(Ar) for an hr at 160° F. (71° C.) and a stirring rate of about 400 rpm. Then carbon steel PAIR® electrodes were immersed in the mixture and the corrosion rate was monitored for about 22 hr under continuous 1% $H_2S$ sparge. A few corrosion tests were also conducted using tap water with no additional electrolyte except HCl, used for pH adjustment of the solution.

For each of a series of tests in comparison to a blank run (no inhibitor added), a quaternary salt of pyridine (Grade 10, prepared from Grade 11 or Akolidine 10 from Lonza of Switzerland) and benzyl chloride (70% quaternized) was added to an identical mixture in another kettle. In some of these tests, cetyltrimethyl ammonium bromide (in a pyridine quat.:CTAB weight ratio of 40:25) was also added. The corrosion rate profiles at inhibitor concentration level of 50 ppm in the presence and absence of the cosurfactant were studied. In the absence of the surfactant, the integrated average corrosion rate was 31 mpy with a steady state corrosion rate of 21 mpy, and in the presence of the surfactant the effectiveness was enhanced, and the integrated average corrosion rate was 6.6 mpy with a steady state corrosion rate of 4 mpy. In the absence and presence of the surfactant the two phases (hydrocarbon and aqueous) separated very cleanly with no coloration in any of the phases. A longer period test (68 hr) gave an integrated average corrosion rate of 3.0 mpy and a steady state corrosion rate of 2.5 mpy for the inhibitor in combination with the surfactant.

EXAMPLE 2

Compositions were tested with a side stream analyzer in operation in a refinery crude unit distillation tower overhead unit. The side stream analyzer functioned by condensation of the vapors with an air cooled condenser followed by a gas separator, which fed an accumulator. The liquid phase was pumped into three cells in a series with a volume of about 320 ml each. The total volume of the accumulator and the three cells was 3 liters. The liquids were recycled through the accumulator. An appropriate aliquot of the inhibitor was injected with a pump or with a syringe into a cell and corrosion rate was monitored.

The following formulation was tested:

| Formulation | Weight % |
|---|---|
| pyridine/benzylchloride quat. | 40 |
| dicholoroethyl ether/dimethylcocoamine quat. (50% mixture) | 50 |
| alcohol | 5.5 |
| water | 4.5 |

On the side stream analyzer the baseline corrosion rate was monitored for about an hour, then 60 ppm (based on total volume of 3 liters) of the inhibitor formulation was injected. The corrosion rate dramatically dropped from about 50 mpy down to less than 1 mpy within 5 minutes, and continued to drop below 0.5 mpy for the next hour. The pH of the water phase before the injection of the inhibitor was about 5.1 and at the end of the test about 4.9. The hydrocarbon phase before the injection of the inhibitor was somewhat cloudy and after the injection of the inhibitor appeared very clean. The aqueous phase developed some cloudiness, which upon standing became clear.

The same formulation evaluated in the side stream test was also evaluated in a kettle test (See Example 1, above, for test procedures) in the lab. The side stream conditions were simulated in the lab. Upon injection of the inhibitor the corrosion rate dramatically dropped from about 300 mpy (pH=4.5) down to less than 10 mpy with a steady state corrosion rate at the end of the test of less than 1 mpy. The integrated average corrosion rate excluding the precorrosion period was less than 1 mpy. The hydrocarbon and the aqueous phases gave a clean interface, and each phase was clean as well.

On another side stream test at a later date, the baseline corrosion rates started out at 50 to 70 mpy in two cells, however, within 15 minutes the corrosion rates were down to 30 to 40 mpy. Based on the laboratory and the earlier side stream tests it was expected that upon injection of the inhibitor the corrosion rate will readily drop from 30 to 40 mpy down to zero. To get a good feel for the performance of the inhibitor, the pH of the water in the side stream was artificially lowered with HCl to about 1. Under these conditions, upon injection of 20 ppm inhibitor the corrosion rate dropped from greater than 1000 mpy (the maximum measurable scale was 1000 mpy, in the laboratory at this pH the corrosion rate is several thousand) down to 20 mpy within 10 minutes and was down to 12 mpy within 20 minutes. The pH of the aqueous phase at the end of the test was still 1, thus the drop in the corrosion rate was not due to the depletion of the hydrogen ion concentration.

EXAMPLE 3

The kettle test procedure of Example 1 was followed with an inhibitor comprising 0.4 ml of a 10% active mixture of the pyridine/benzyl chloride quaternary salt of Example 1 and 0.3 of a 10% active mixture of a dimethylcocoamine/benzyl chloride quaternary salt. The kettle test was initiated with a pre-additive corrosion period of 1.2 hours. Pre-additive corrosion, sometimes called pre-corrosion, refers to the period before addition of the inhibitor. Samples had a starting pH of 4.5. Upon addition of the quaternary salts, the corrosion rates showed a dramatic drop. The integrated corrosion rate including the pre-additive period was about 22 mpy, and excluding the pre-additive period was about 1 mpy, with a steady state rate of less than 1 mpy. The two phases of the oil/water system showed a clear separation readily.

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed:

1. A method for inhibiting corrosion of ferrous surfaces in an acidic, aqueous medium, comprising incorporating into the medium a corrosion-inhibiting amount of (1) a pyridine salt composition containing a pyridine salt selected from the group consisting of quaternary pyridine salts, pyridine.HCl salts and mixtures thereof, and (2) a cationic surfactant that forms a bilayer on the ferrous surfaces in the medium.

2. A method as set forth in claim 1, wherein the pyridine salt composition contains a quaternary pyridine salt that is at least about 70% quaternized.

3. A method as set forth in claim 2, wherein the quaternary pyridine salt is a quaternary salt of a pyridine-containing composition and a compound of the formula R-X wherein R is selected from the group consisting of alkyl and aryl groups of up to about seven carbon atoms, and X is a halide, wherein at least 70% of the pyridines in the pyridine-containing composition are quaternized.

4. A method as set forth in claim 3, wherein R is selected from the group consisting of benzyl and methyl.

5. A method as set forth in claim 4, wherein X is chloride.

6. A method as set forth in claim 5, wherein the R is benzyl and the surfactant is selected from the groups consisting of a quaternary salt of benzyl chloride and dialkylcocoamine, a quaternary salt of dichloroethyl ether and dialkylcocoamine and cetyltrimethyl ammonium bromide.

7. A method as set forth in claim 4, wherein the cationic surfactant is selected from the group consisting of (a) quaternary ammonium halides of the formula:

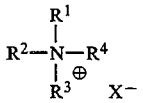

wherein $R^1$ is an alkyl or alkylaryl group of from about 12 to about 18 carbon atoms, the aryl portion of the alkylaryl group containing no more than about six carbon atoms, $R^2$–$R^4$ are independently selected from among methyl, ethyl and benzyl, provided that at most only one of $R^2$–$R^4$ is benzyl, and X is a halide, and (b) quaternary salts of mono-haloalkyl ethers or dihaloalkyl ethers of from two to about six carbon atoms and trialkyl amines of the formula:

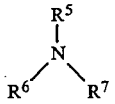

wherein $R^5$ is an alkyl group of from about 12 to about 18 carbon atoms, and $R^6$ and $R^7$ are independently selected from among methyl, ethyl and propyl, provided that the total number of carbon atoms of $R^6$ and $R^7$ is at most about four.

8. A method as set forth in claim 7, wherein the surfactant is selected from the group consisting of a quaternary salt of benzyl chloride and dialkylcocoamine, a quaternary salt of dichloroethyl ether and dialkylcocoamine and cetyltrimethyl ammonium bromide.

9. A method as set forth in claim 3, wherein the cationic surfactant is selected from the group consisting of (a) quaternary ammonium halides of the formula:

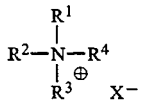

wherein $R^1$ is an alkyl or alkylaryl group of from about 12 to about 18 carbon atoms, the aryl portion of the alkylaryl group containing no more than about six carbon atoms, $R^2$–$R^4$ are independently selected from among methyl, ethyl and benzyl, provided that at most only one of $R^2$–$R^4$ is benzyl, and X is a halide, and (b) quaternary salts of mono-haloalkyl ethers or dihaloalkyl ethers of from two to about six carbon atoms and trialkyl amines of the formula:

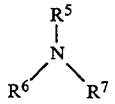

wherein $R^5$ is an alkyl group of from about 12 to about 18 carbon atoms, and $R^6$ and $R^7$ are independently selected from among methyl, ethyl and propyl, provided that the total number of carbon atoms of $R^6$ and $R^7$ is at most about four.

10. A method as set forth in claim 9, wherein the surfactant is selected from the group consisting of a quaternary salt of benzyl chloride and dialkyl cocoamine, a quaternary salt of dichloroethyl ether and dialkylcocoamine and cetyltrimethyl ammonium bromide.

11. A method as set forth in claim 2, wherein the quaternary pyridine salt and the cationic surfactant are incorporated into the medium in a relative salt composition:surfactant molar proportion of from about 5:1 to about 1:5.

12. A method as set forth in claim 1, wherein the cationic surfactant is selected from the group consisting of (a) quaternary ammonium halides of the formula:

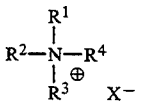

wherein $R^1$ is an alkyl or alkylaryl group of from about 12 to about 18 carbon atoms, the aryl portion of the alkylaryl group containing no more than about six carbon atoms, are $R^2$–$R^4$ are independently selected from among methyl, ethyl and benzyl, provided that at most only one of $R^2$–$R^4$ is benzyl, and X is a halide; and (b) quaternary salts of mono-haloalkyl ethers or dihaloalkyl ethers of from two to about six carbon atoms and trialkyl amines of the formula:

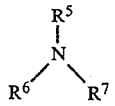

wherein $R^5$ is an alkyl group of from about 12 to about 18 carbon atoms, and $R^6$ and $R^7$ are independently selected from among methyl, ethyl and propyl, provided that the total number of carbon atoms of $R^6$ and $R^7$ is at most about four.

13. A method as set forth in claim 12, wherein the surfactant is selected from the group consisting of a quaternary salt of benzyl chloride and dialkylcocoamine, a quaternary salt of dichloroethyl ether and dialkylcocoamine and cetyltrimethyl ammonium bromide.

14. A method as set forth in claim 13, wherein the dialkylcocoamine is dimethylcocoamine.

15. A method as set forth in claim 12, wherein the quaternary pyridine salt and the cationic surfactant are incorporated into the medium in a relative salt composition:surfactant molar proportion of from about 5:1 to about 1:5.

16. A method as set forth in claim 15, wherein the cationic surfactant is a benzyl chloride quaternary salt of dimethylcocoamine.

17. A method as set forth in claim 1, wherein the pyridine salt composition and the cationic surfactant are incorporated into the medium in a relative salt composition:surfactant molar proportion of from about 5:1 to about 1:5.

18. A method as set forth in claim 1, wherein the medium has a pH of less than about 4.

* * * * *